US012070128B2

(12) United States Patent
Zhang

(10) Patent No.: US 12,070,128 B2
(45) Date of Patent: Aug. 27, 2024

(54) RECLINER CHAIR FOR CINEMA

(71) Applicant: Jiuzhi Zhang, Guangdong (CN)

(72) Inventor: Jiuzhi Zhang, Guangdong (CN)

( * ) Notice: Subject to any disclaimer, the term of this patent is extended or adjusted under 35 U.S.C. 154(b) by 0 days.

(21) Appl. No.: 17/883,802

(22) Filed: Aug. 9, 2022

(65) Prior Publication Data

US 2023/0346124 A1 Nov. 2, 2023

(30) Foreign Application Priority Data

Apr. 28, 2022 (CN) ..... 202221026737.7

(51) Int. Cl.
*A47C 1/12* (2006.01)
*A47C 1/034* (2006.01)

(52) U.S. Cl.
CPC ..... *A47C 1/12* (2013.01); *A47C 1/034* (2013.01)

(58) Field of Classification Search
CPC ..... A47C 1/12; A47C 1/0242; A47C 1/034; E04H 3/30
USPC ..... 297/217.7, 362.11
See application file for complete search history.

(56) References Cited

U.S. PATENT DOCUMENTS

| | | | | |
|---|---|---|---|---|
| 5,790,997 | A * | 8/1998 | Ruehl | A47C 17/162 297/316 |
| 6,293,621 | B1 * | 9/2001 | Marsh | A47C 7/566 297/335 |
| 6,742,206 | B1 * | 6/2004 | Han | A61G 7/165 5/85.1 |
| 10,045,621 | B1 * | 8/2018 | Welter | A47C 1/0347 |
| 10,220,949 | B2 * | 3/2019 | Thomaschewski | B64D 11/064 |
| 10,888,162 | B1 * | 1/2021 | McLennan | A47C 1/124 |

FOREIGN PATENT DOCUMENTS

| | | |
|---|---|---|
| CN | 202198161 U | 4/2012 |
| CN | 206275436 U | 6/2017 |

* cited by examiner

*Primary Examiner* — Sarah B McPartlin

(57) ABSTRACT

The invention provides a novel recliner chair suitable for a cinema, which relates to a chair used in a cinema, a conference hall and other public places, in particular to a chair mounted on stepped ground of the above occasions. An underframe and an electric recliner chair body fixed on the underframe are included. The underframe includes a horizontal frame and a vertical frame, and the horizontal frame and the vertical frame are arranged in a "T"-shaped manner. The recliner chair in the invention is suitable for the stepped ground, and is convenient to mount and firm to fix. And the floor area ratio per unit area may be improved, so that the designed accommodation number of people in the whole cinema becomes larger.

5 Claims, 2 Drawing Sheets

RECLINER CHAIR FOR CINEMA

TECHNICAL FIELD

The invention provides a novel recliner chair suitable for a cinema, which relates to a chair used in a cinema, a conference hall and other public places, in particular to a chair mounted on stepped ground of the above occasions.

BACKGROUND

For a chair mounted in an existing cinema or conference hall, legs of a chair frame are directly fixed on the ground, a backrest motor pushing device is mounted below the chair frame to enable a backrest to tilt, and a foot stand motor pushing device is mounted below the chair frame to enable the foot stand retractable. In such design, a certain space must be reserved under the chair frame for mounting the backrest motor pushing device and the foot stand motor pushing device, and the mounting height of the chair frame shall be convenient and labor-saving when a person sits down or stands up. It is also necessary to ensure that the front and back sight is not blocked, so the height difference between the existing chair rows is large, and accordingly, the floor area ratio of the whole place becomes smaller and the designed accommodation number of people of the place becomes smaller.

SUMMARY

The invention aims to provide a novel recliner chair suitable for a cinema. The novel recliner chair is suitable for stepped ground, and is convenient to mount and firm to fix. And the volume ratio per unit area may be improved, so that the designed accommodation number of people in the whole cinema becomes larger.

In a technical solution of the invention, a novel recliner chair suitable for a cinema may include an underframe and an electric recliner chair body fixed on the underframe. The underframe includes a horizontal frame and a vertical frame, and the horizontal frame and the vertical frame are arranged in a "T"-shaped manner. The horizontal frame includes a horizontal frame left part and a horizontal frame right part, a horizontal frame mounting hole is formed in the horizontal frame right part, and a vertical frame mounting hole is formed in the vertical frame.

According to the novel recliner chair suitable for a cinema, a backrest bracket and a backrest motor pushing device are mounted on the horizontal frame right part, the backrest bracket is hinged with the horizontal frame right part, and the backrest motor pushing device is hinged with the backrest bracket.

According to the novel recliner chair suitable for a cinema, the horizontal frame left part is provided with a foot stand and a foot stand motor pushing device, and the foot stand is hinged with the foot stand motor pushing device.

According to the novel recliner chair suitable for a cinema, the foot stand and the foot stand motor pushing device are mounted below the horizontal frame left part.

The invention has the beneficial effects that a "T"-shaped underframe composed of a horizontal frame and a vertical frame is suitable for the stepped ground, and is convenient to mount, firm to fix, and safe. The backrest motor pushing device is located above the horizontal frame right part and the foot stand motor pushing device is located below the horizontal frame left part, which may effectively reduce the height of the recliner chair, improve the floor area ratio per unit area, and increase the designed accommodation number of people of the whole cinema.

DETAILED DESCRIPTION OF THE EMBODIMENTS

The present invention is further elaborated below in combination with embodiments and accompanying drawings.

Figure 1:
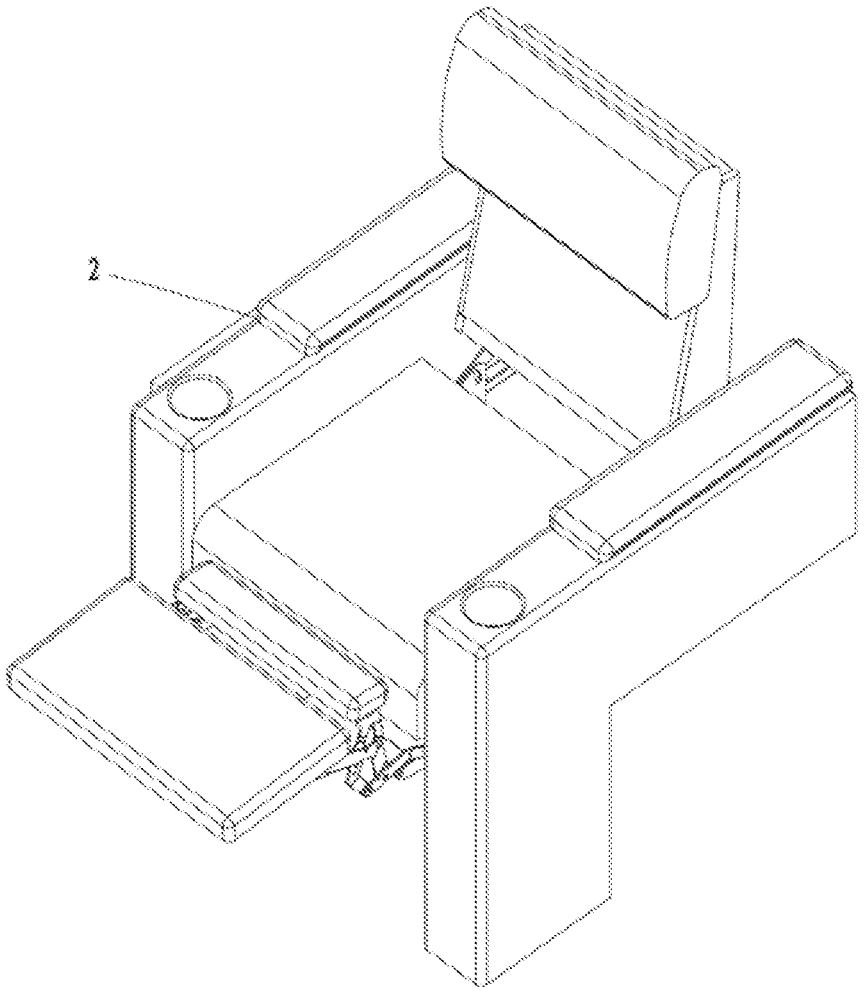
FIG. 1 is a schematic diagram of an embodiment of a novel recliner chair suitable for a cinema in the invention.
Figure 2:
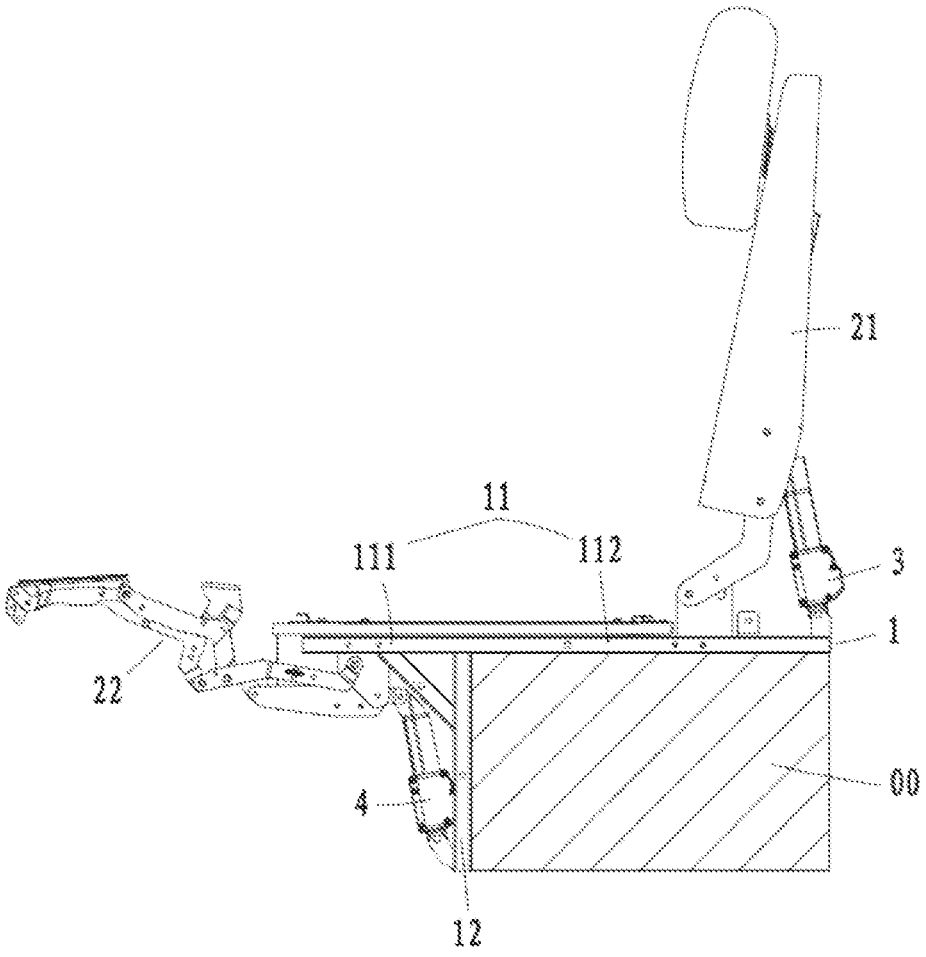
FIG. 2 is a schematic diagram of an underframe when a foot stand shown in FIG. 1 stretches out.

Referring to FIGS. 1 and 2, which are embodiments of a novel recliner chair suitable for a cinema in the invention. An underframe 1 and an electric recliner chair body 2 fixed on the underframe 1 are included. The underframe 1 includes a horizontal frame 11 and a vertical frame 12, and the horizontal frame 11 and the vertical frame 12 are arranged in a "T"-shaped manner. The horizontal frame 11 includes a horizontal frame left part 111 and a horizontal frame right part 112. A horizontal frame mounting hole is formed in the horizontal frame right part 112. A plurality of horizontal frame mounting holes may be provided. The horizontal frame 11 is fixed to stepped ground with a screw. A vertical frame mounting hole is formed in the vertical frame 12 for fixing the vertical frame 12 to the stepped ground 00. Such a "T"-shaped underframe has ample space for mounting, facilitates working by an installer or a maintenance worker, and is convenient to mount, firm to fix, and safe.

A backrest bracket 21 and a backrest motor pushing device 3 are mounted on the horizontal frame right part 112, the backrest bracket 21 is hinged with the horizontal frame right part 112, and the backrest motor pushing device 3 is hinged with the backrest bracket 21. Thus, the backrest motor pushing device 3 may push the backrest bracket 21 to tilt. A foot stand 22 and a foot stand motor pushing device 4 are mounted below the horizontal frame left part 111, and the foot stand 22 is hinged with the foot stand motor pushing device 4. Thus, the foot stand motor pushing device 4 may push the foot stand 22 to stretch out and retract. According to the embodiment structure, the backrest motor pushing device is located above the horizontal frame right part and the foot stand motor pushing device is located below the horizontal frame left part, which may effectively reduce the height of the recliner chair, improve the floor area ratio per unit area, and increase the designed accommodation number of people of the whole cinema.

The above is only a preferred implementation mode of the invention. It is to be pointed out that, for those of ordinary skill in the art, without departing from the concept of the invention, several modifications and improvements may also be made, which all fall within the scope of protection of the invention.

What is claimed is:

1. A novel recliner chair suitable for a cinema, comprising an underframe (1) and an electric recliner chair body (2) fixed on the underframe, wherein the underframe (1) comprises a horizontal frame (11) and a vertical frame (12), the horizontal frame (11) and the vertical frame (12) being arranged in a "T"-shaped manner, the horizontal frame (11) comprising a horizontal frame left part (111) and a horizontal frame right part (112), a horizontal frame mounting hole being formed in the horizontal frame right part (112), and a vertical frame mounting hole being formed in the vertical frame (12), wherein the horizontal frame mounting hole (1121) of the horizontal frame (11) is configured to be fixed to a top of a stepped ground (00) with a screw, and the vertical frame mounting hole (121) of the vertical frame (12) is configured to be fixed to a side of the stepped ground (00) with a screw, a backrest motor pushing device (3) is located above the horizontal frame right part (112) and a foot stand motor pushing device (4) is located below the horizontal frame left part (111).

2. The novel recliner chair suitable for a cinema of claim 1, wherein a backrest bracket (21) and a backrest motor pushing device (3) are mounted on the horizontal frame right part (112), the backrest bracket (21) being hinged with the horizontal frame right part (112), and the backrest motor pushing device (3) being hinged with the backrest bracket (21).

3. The novel recliner chair suitable for a cinema of claim 1, wherein the horizontal frame left part (111) is provided with a foot stand (22) and a foot stand motor pushing device (4), the foot stand (22) being hinged with the foot stand motor pushing device (4).

4. The novel recliner chair suitable for a cinema of claim 3, wherein the foot stand (22) and the foot stand motor pushing device (4) are mounted below the horizontal frame left part (111).

5. The novel recliner chair suitable for a cinema of claim 2, wherein the horizontal frame left part (111) is provided with a foot stand (22) and a foot stand motor pushing device (4), the foot stand (22) being hinged with the foot stand motor pushing device (4).

* * * * *